US006754356B1

(12) United States Patent
Luo et al.

(10) Patent No.: US 6,754,356 B1
(45) Date of Patent: Jun. 22, 2004

(54) TWO-STAGE ADAPTIVE FEEDBACK CANCELLATION SCHEME FOR HEARING INSTRUMENTS

(75) Inventors: Fa-Long Luo, Redwood City, CA (US); Jun Yang, Redwood City, CA (US); Caslav Pavlovic, Palo Alto, CA (US); Arye Nehorai, Highland Park, IL (US)

(73) Assignee: GN ReSound AS, Taastrup (DK)

( * ) Notice: Subject to any disclaimer, the term of this patent is extended or adjusted under 35 U.S.C. 154(b) by 688 days.

(21) Appl. No.: 09/684,294

(22) Filed: Oct. 6, 2000

(51) Int. Cl.[7] ..... H04R 25/00
(52) U.S. Cl. ..... 381/318; 381/317
(58) Field of Search ..... 381/318, 317, 381/321, 312, 96, 95, 93, 66; 379/406.01, 406.02, 406.05, 406.06, 406.08, 406.15

(56) References Cited

U.S. PATENT DOCUMENTS 6,219,427 B1 * 4/2001 Kates et al. ..... 381/318
6,480,610 B1 * 11/2002 Fang et al. ..... 381/321
6,498,858 B2 * 12/2002 Kates ..... 381/318
2002/0057814 A1 * 5/2002 Kaulberg ..... 381/312
2002/0064291 A1 * 5/2002 Kates et al. ..... 381/318
2002/0094100 A1 * 7/2002 Kates et al. ..... 381/318

OTHER PUBLICATIONS

Kates, James M., Constrained Adaptation for Feedback Cancellation in Hearing Aids, 1010 *J. Accoust. Soc. Am.* 106 (2), Aug. 1999.
Breining, Christina, et al., Accoustic Echo Control, *IEEE Signal Processing Magazine*, Jul. 1999.
Wyrsch, Sigisbert and Kaelin, Aug., Adaptive Feedback Cancelling in Subbands for Hearing Aids, IEEE Signal Processing Magazine, 1999.

* cited by examiner

*Primary Examiner*—Stella Woo
(74) *Attorney, Agent, or Firm*—Bingham McCutchen LLP; David G. Beck

(57) ABSTRACT

A feedback cancellation system for a hearing instrument is described. The feedback cancellation system includes both a constrained adaptive filter, the constrained adaptive filter can be constrained by initiation coefficients, as well as an adaptive gain modification. The adaptive gain modification allows the feedback cancellation to respond to substantially different environments from the test environment used to derive the initiation coefficients for the constrained adaptive filter.

17 Claims, 4 Drawing Sheets

TWO-STAGE ADAPTIVE FEEDBACK CANCELLATION SCHEME FOR HEARING INSTRUMENTS

BACKGROUND OF THE INVENTION

The present invention relates to feedback cancellation methods and apparatus.

A problem that can occur with hearing instruments such as hearing aids is that the output of a speaker can feed back into the input microphone and in some circumstances can result in an out-of-control positive-feedback oscillation. This can occur in systems such as hearing aids which amplify the received input signals to produce an amplified output signal to a speaker. If the amplified output signal is not sufficiently attenuated at the input microphone, input noises will continue to loop through the feedback path until the annoying ring of positive feedback occurs.

A number of methods and techniques have been designed to overcome this feedback problem. These methods typically use digital signal processing (DSP). Most DSP-based feedback-cancellation techniques typically estimate the feedback signal and then subtract this estimated feedback signal from the microphone signal. Because the feedback paths are varying, adaptive feedback cancellation is necessary.

One way to do adaptive feedback cancellation is to use a noise sequence continuously injected at a low level while the hearing instrument is in normal operation. This approach has the disadvantage of reducing the signal-to-noise ratio.

Another adaptive feedback cancellation approach is to use an adaptive filter connected to the output of the hearing aid processing unit and subtract the output of the adaptive filter from the microphone signal. FIG. 1 illustrates an example of this prior-art embodiment.

The system includes a microphone 22 which sends a signal to the subtracting unit 24. Subtracting unit 24 subtracts the microphone signal from the output of the adaptive filter 26. This combined signal is sent to the hearing aid processing unit 28 which produces an output which is then sent to the speaker 30 to produce the output.

The system of FIG. 1 operates relatively well when a broadband input signal is sent to the microphone. If the input is a narrowband signal, however, artifacts are produced and a degraded performance results.

A system that avoids some of these problems is described in the article "Constrained Adaptation for Feedback Cancellation in Hearing Aids," by James M. Kates, *Journal of the Acoustical Society of America*, 106 (2), August 1999, pp. 1010–1019. This article describes a constrained adaptive feedback cancellation scheme.

Let x(n), f(n) and v(n) denote the input of the system, the output of the feedback path and the output of the adaptive FIR filter, respectively, then we have the microphone output s(n)=x(n)+f(n) and the difference signal e(n)=s(n)−v(n). In the standard approach, the weights W(n) of the adaptive FIR filter are updated by minimizing the power of e(n) so that the output of the adaptive filter could track the signal f(n) provided by the real feedback path and the effect incurred by feedback could be minimized. In the ideal case, v(n) approximates f(n) so that e(n) could approximate the real input signal x(n) without any feedback signal. In the constrained adaptation scheme, the cost function for updating weights in the block-by-block processing mode is $$\epsilon(m) = \sum_{n=0}^{N-1} e_n^2(m) = \sum_{n=0}^{N-1} [s_n(m) - v_n(m)]^2 + \beta \sum_{k=0}^{K-1} [w_k(m) - w_k(0)]^2 \quad \text{Equation 1}$$

and one algorithm to update the weights is $$w_k(m) = w_k(m-1) - 2\mu\beta[w_k(m-1) - w_k(0)] + 2\mu \sum_{n=0}^{N-1} e_n(m-1) d_{n-k}(m-1) \quad \text{Equation 2}$$

where $s_n(m)$, $v_n(m)$ are the microphone output signal (corresponds to s(n)) and the output of the adaptive filter (corresponds to v(n)) at block m, respectively; N and K are the sample number in one block and the length of the adaptive filter, respectively; $d_{n-k}(m-1)$ is the input of the FIR filter at time instant (n−k) of the (m−1)'th block. The major difference between this constrained adaptive feedback cancellation scheme and the standard adaptive scheme is the inclusion of the constrained term $$\beta \sum_{k=0}^{K-1} [w_k(m) - w_k(0)]^2$$

in the above cost function where β is a weighting factor, $w_k(m)$ is the k'th weight at m'th block, and $w_k(0)$ is the k'th initial weight. These initial weights provide a reference set of adaptive filter weights and can be obtained during the hearing-aids fitting stage by letting the system adapt in the presence of a white-noise source until the adaptive filter reaches steady state. With this constraint, the feedback cancellation filter can freely adapt near the initial coefficients but penalize coefficients that deviate too far from the initial values. Testing has shown that this constraint-based algorithm is effective in overcoming artifacts and signal cancellation problems but does not effectively model large deviations from the initial feedback path such as that caused by the placement and removal of a telephone handset. For example, if the amplitude transform function of the real feedback path is shifted above 10 dB (as happens when a telephone handset is placed to the aided ear) from the initial feedback path (corresponds to $w_k(0)$), the real optimizing weights of the adaptive filter should be $w_k(M)=3.16w_k(0)$. Obviously, this solution cannot be obtained by minimizing the Equation 1 mainly because of the constraint term (the second term of the right hand of Equation 1).

Based on these problems, it is highly desirable to develop a new scheme which can not only overcome the artifacts and signal cancellation problem but also have the ability to model large variations of the feedback path.

SUMMARY OF THE PRESENT INVENTION

One embodiment of the present invention is a system that includes a sound processing unit producing an output. A multi-stage feedback canceling unit receives the output of the sound processing unit. The multi-stage feedback canceling unit produces a feedback canceling signal. The multi-stage feedback canceling unit includes a constrained adaptive filter and an adaptive gain-modifying unit. The system also includes a combining unit, combining the feedback canceling signal with an input signal, and providing the combined signal as the input to the sound processing unit.

In one embodiment the sound processing unit is a hearing aid. The sound processing unit and multi-stage feedback-canceling unit can be implemented as a software program on a processor such as a DSP.

The advantage of doing an adaptive gain modification in addition to the constrained adaptive filtering is that the adaptive gain modification can make up for some of the reduced output of the constrained adaptive filtering which is the result of the constraints. It has been found that the use of the constrained filtering has the disadvantage that when the environment of the hearing instrument is drastically different from the normal environment for which the constraining coefficients are developed, the output of the adaptive filter can be quite different than the feedback sound signal. For example, when a telephone handset is placed next to a hearing aid device using the constrained adaptive filter in the feedback canceling path, the real feedback path can be much greater than the output of the adaptive filter. The constraint terms prevent the correct operation of the feedback path.

In the present invention, by adding an adaptive gain element, the output of the two-stage feedback-canceling unit can be made relatively close to the signal of the feedback path. The constrained adaptive filtering prevents the feedback path from adjusting its filter shape so as to cause the undesired behavior for narrowband input signals. The adaptive gain modifying block changes the overall gain of the feedback-canceling path without inducing the poor behavior for the narrowband input.

DETAILED DESCRIPTION OF THE PREFERRED EMBODIMENT

Figure 1:
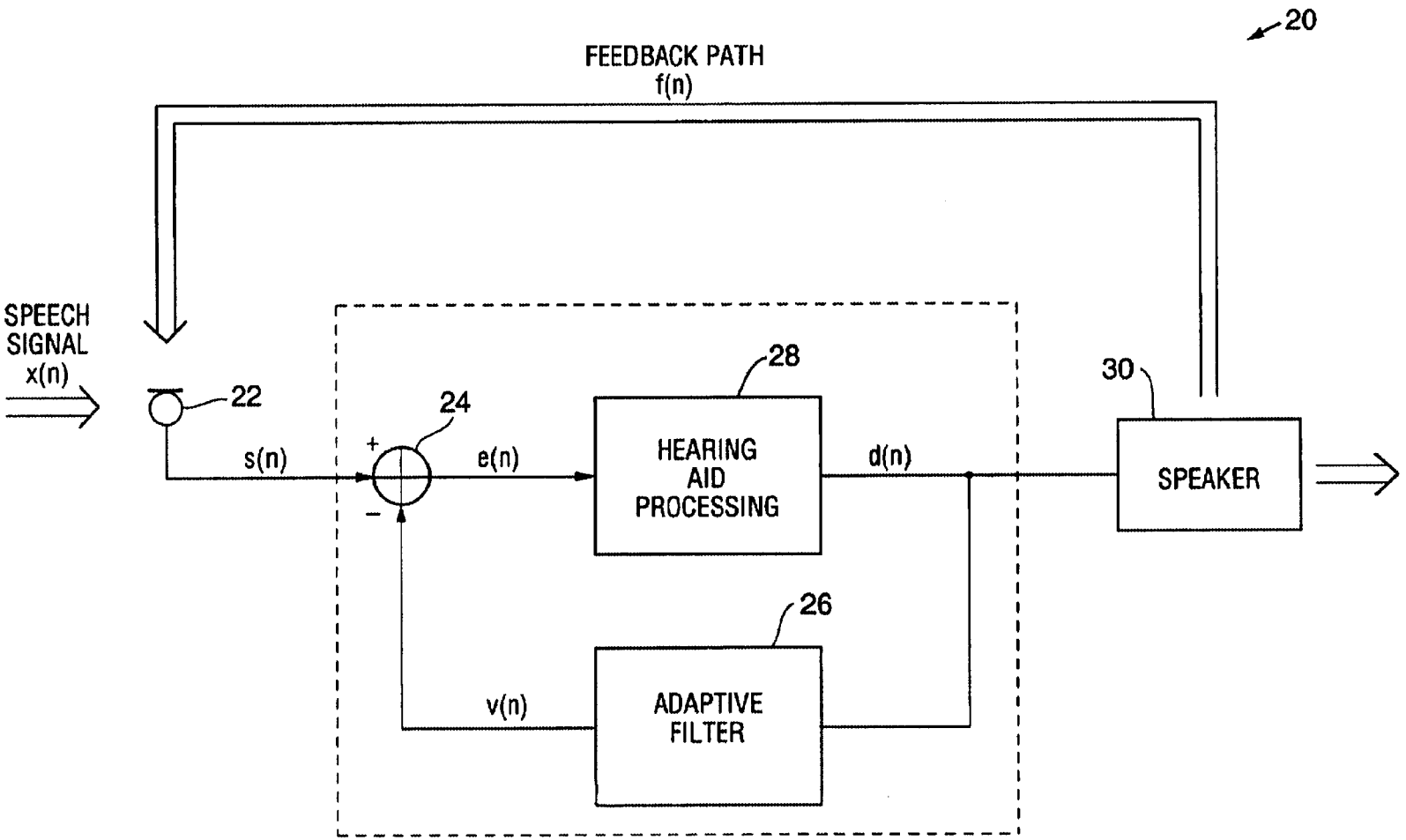
FIG. 1 (PRIOR ART)
FIG. 1 is a diagram of a prior-art hearing instrument with feedback cancellation.
Figure 2:
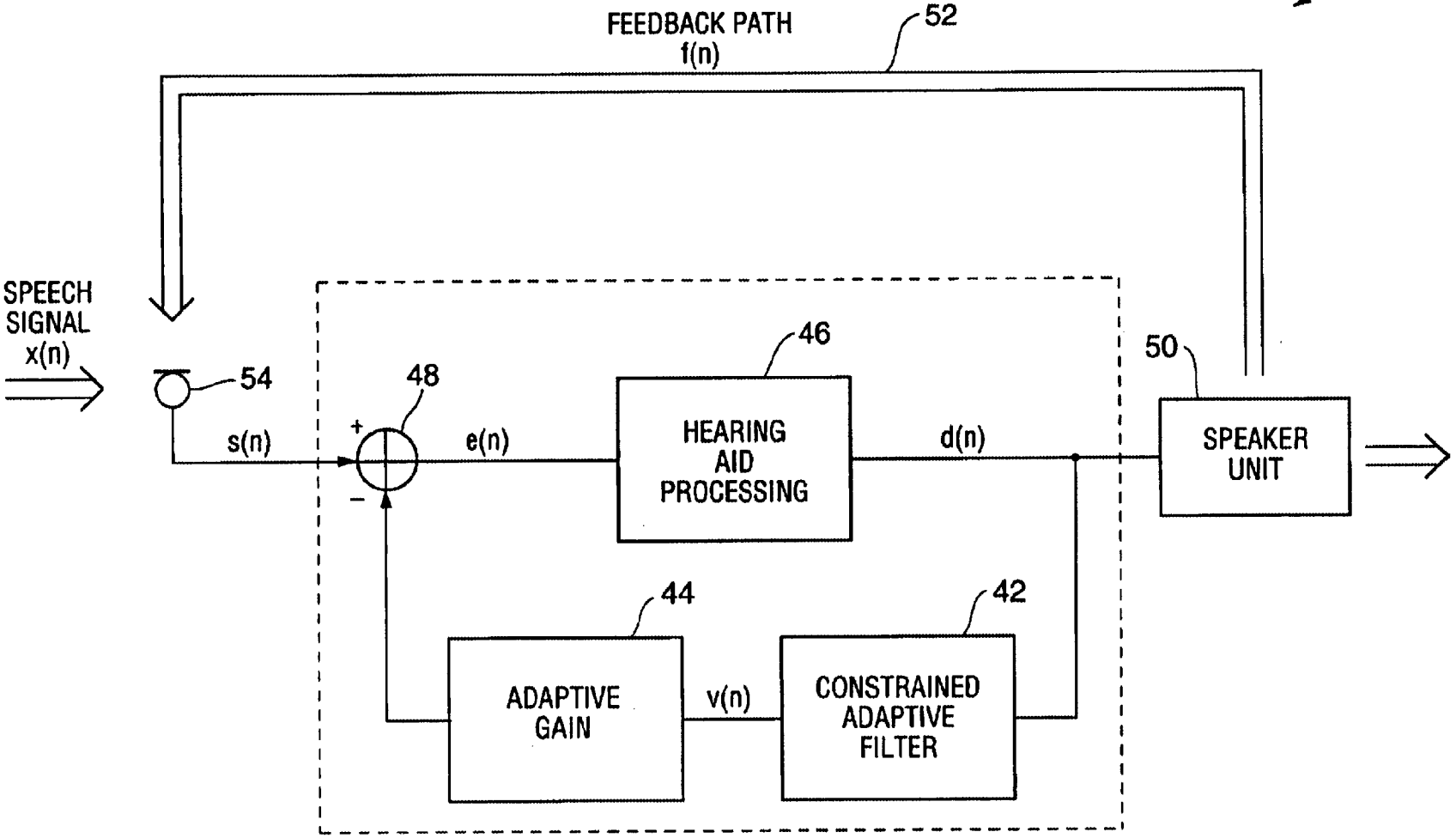
FIG. 2 is a diagram of the hearing instrument with feedback cancellation of the present invention.

FIG. 2 illustrates the hearing instrument with feedback cancellation 40 of one embodiment of the present invention. In this embodiment the feedback cancellation path includes a constrained adaptive filter 42. The constrained adaptive filter 42 is an adaptive filter which is constrained by initiation constants for the filter. The constrained adaptive filter 42 will not move too far away from these initiation constants. This can be done by including an indication of the distance between the initial constants and later constants as a term in the cost function which is to be minimized. A description of this constrained adaptive filter is given in the article by Kates referenced above. A disadvantage of using a constrained adaptive filter is that there can be environments which are quite different from the situation where the initiation constants are developed. The constraints on the adaptive filter 42 prevent the adaptive filter from moving too far away from the initialized constants. This has the advantage that the constants cannot be moved so far away from the initialized values as to produce degraded performance and artifacts if the input is a narrowband signal.

A downside of using a constrained adaptive filter is that in some situations the constraints prevent the feedback cancellation path from adequately responding to a changed environment. For example, if a hearing aid is positioned adjacent to a telephone receiver, a feedback path can increase dramatically. In one embodiment, an adaptive gain unit 44 is provided so as to amplify the feedback cancellation output so it will reach the rough magnitude of the feedback path. As described below, one way of doing this is to use a ratio of the correlation of the s(n) signal with the v(n) signal divided by the autocorrelation of the v(n) signal.

In one embodiment, the adaptive gain element 44 is an element that also does some filtering. In a preferred embodiment, the adaptive gain element 44 oly does gain modification.

In a preferred embodiment, hearing-aid processor 46 is used, but in other embodiments other types of sound processing can be used. The output of the hearing aid processor is used as the input to the feedback cancellation path. The feedback cancellation signal is subtracted from the signal from the microphone in the combining unit 48. This combining unit 48 is preferably a subtractor but could also be another type of combiner. The output of the subtractor 48 is supplied to the hearing aid processor 46. The hearing aid processor 46 can be the conventional hearing-aid processing such as the amplification of the signal at different frequencies. The output of the hearing-aid processor 46 is also provided to a speaker unit which converts the signal into an audio signal provided to the user. The speaker 50 also may have a feedback path 52 back to the microphone 54. It is this feedback path 52 which is meant to be compensated for by the elements of the feedback cancellation path (the constrained adaptive filter 42 and the adaptive gain unit 44). Below we discuss one embodiment for an algorithm to implement this two-stage feedback calculation system.

The first-stage adaptation is accomplished by an adaptive gain which is cascaded after the adaptive FIR filter and before the difference operation as shown in FIG. 2, that is, the error e(n) becomes $$e(n)=s(n)-\text{gain}(n)*v(n) \qquad \text{Equation 3}$$

The main function of this stage is to track the deviation in average magnitude of feedback path transfer function from the initial feedback path (corresponds to $w_{k(}0)$) and is called as the roughly adaptive stage. This adaptive gain can be obtained by the following algorithm $$gain(m) = \frac{Rvs(m)}{Rvv(m)} \qquad \text{Equation 4}$$

where Rvs(m) is the cross-correlation between $v_n(m)$ and $s_n(m)$ and Rvv(m) is the power of $v_n(m)$, respectively in block m and can be estimated as follows (denoted by Equation 5 and Equation 6):

$$Rvs(m) = \frac{1}{N}\sum_{n=0}^{N-1} S_n(m)v_n(m) \qquad \text{Equation 5}$$

and $$Rvv(m) = \frac{1}{N}\sum_{n=0}^{N-1} v_n^2(m) \qquad \text{Equation 6}$$

The above algorithm can be obtained by minimizing $E[e^2(n)]$ with assuming that the coefficients of the (K−1)'th FIR adaptive filter are known. In other words, the output $v_n(m)$ of the adaptive FIR filter in the above are calculated by using the coefficients in previous block. For further illustration of function of this roughly adaptive stage, we still consider the above example, that is, assuming that the amplitude of the transform function of real feedback path is shift above 10 dB from the initial feedback path (corresponds to $w_k(0)$), the adaptive gain provided by the above algorithm should be about 3.16, then the total weights (the weights of the FIR filter time the adaptive gain) are about $3.16*w_k(0)$ and further the total amplitude of the variable: gain(n)*v(n) is increased by 10 dB which will approximately cancel the amplitude increase of the physical feedback path. Of course, the real deviation of the feedback path is not only in the amplitude shift, but also that the shape of the transfer function will be changed; this change can be further tracked by updating the (K−1)'th adaptive FIR filter, that is, the second-stage adaptive part of, say, finely adaptive part.

The function of this finely adaptive part is the same as one of the constrained adaptive schemes proposed by Kates and mainly is accomplished by the (K−1)'th adaptive FIR filter. The coefficients of this finely adaptive filter can be obtained by minimizing the following cost function:

$$\epsilon(m) = \sum_{n=0}^{N-1} e_n^2(m) = \sum_{n=0}^{N-1} [s_n(m) - gain(m) * v_n(m)]^2 + \beta \sum_{k=0}^{K-1} [w_k(m) - w_k(0)]^2 \quad \text{Equation 7}$$

and one version based on the least means squared (LMS) algorithm is:

$$w_k(m) = w_k(m-1) - 2\mu\beta(w_k(m-1) - w_k(0)) + 2\mu \sum_{n=0}^{N-1} gain(m-1) * e_n(m-1) d_{n-k}(m-1) \quad \text{Equation 8}$$

Note that in the above two equations, the error becomes $e_n(m)=s_n(m)-gain(m)*v_n(m)$ rather than $e_n(m)=s_n(m)-v_n(m)$ used in Equation 2.

In addition to the function of the fine adaptation, this second-stage adaptive part could also effectively overcome the coloration artifacts and signal cancellation problem as the prior-art scheme mainly because of the constrained term in Equation 7 which is exactly the same as that in Equation 1.

In comparison with the prior art, the constrained adaptive scheme, only one more adaptive gain parameter needs to be calculated. Thus, the additional computational complexity is not large.

Figure 3:
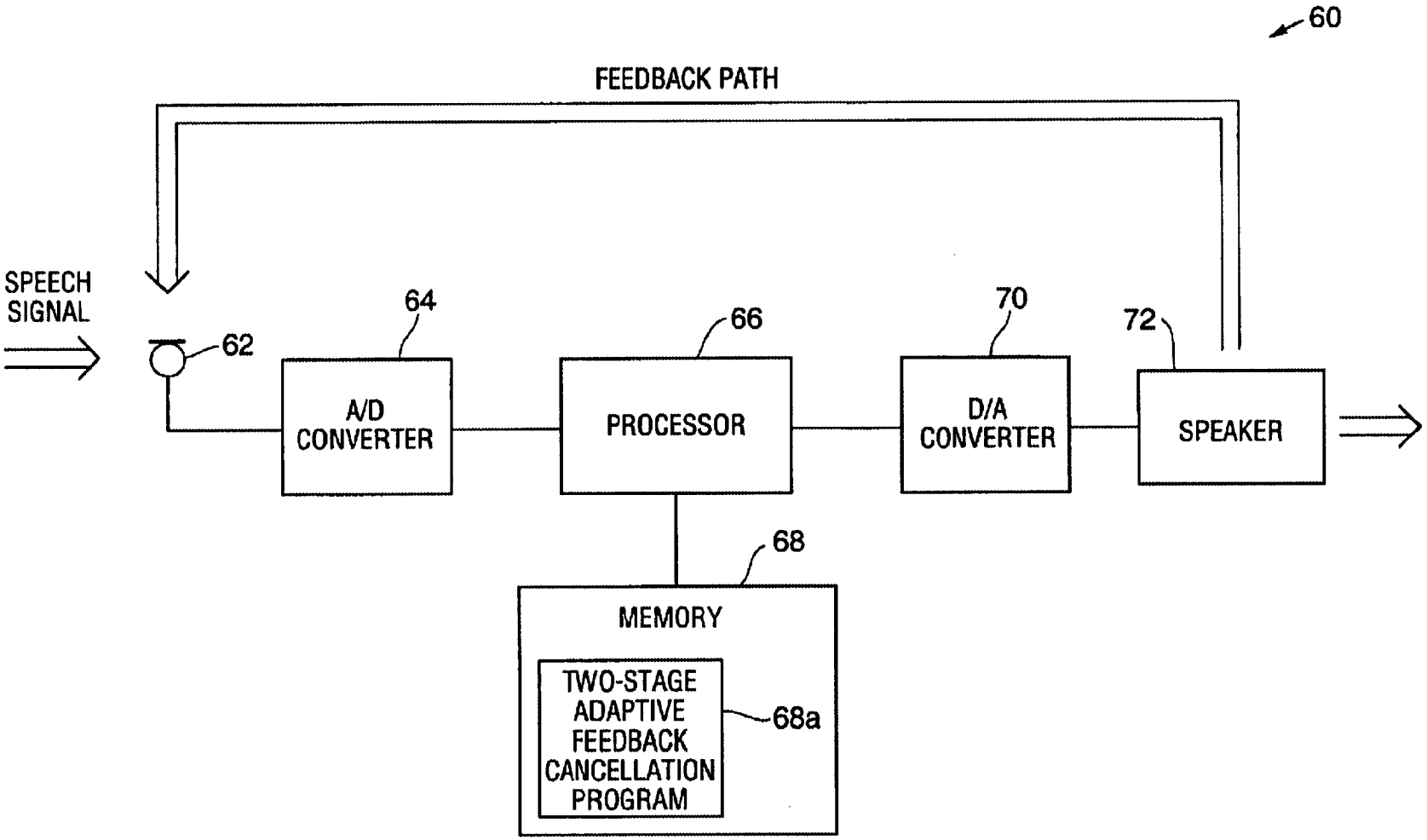
FIG. 3 is a diagram illustrating an implementation of the hearing instrument with feedback cancellation of FIG. 2.

FIG. 3 is a diagram of one embodiment of an implementation of the system of FIG. 2. The implementation 60 includes a microphone 62, an A/D converter 64 converting the microphone samples into digital data, and a processor 66 receiving the digital data. Processor 66 can be, for example, a digital signal processor. The processor 66 is associated with a memory 68 which can include a program 68*a*. The program 68*a* can be a two-stage adaptive feedback cancellation program which implements the algorithm such as the combined hearing-aid processing, adaptive gain processing, and constrained adaptive filtering.

Processor 66 can send digital data to the D/A converter 70. The D/A converter 70 then produces analog signals to speaker 72. Thus, in a preferred embodiment, the hearing-aid processing units, adaptive gain units, constrained adaptive filter units and combining units are implemented as a processor running a computer program.

Figure 4:
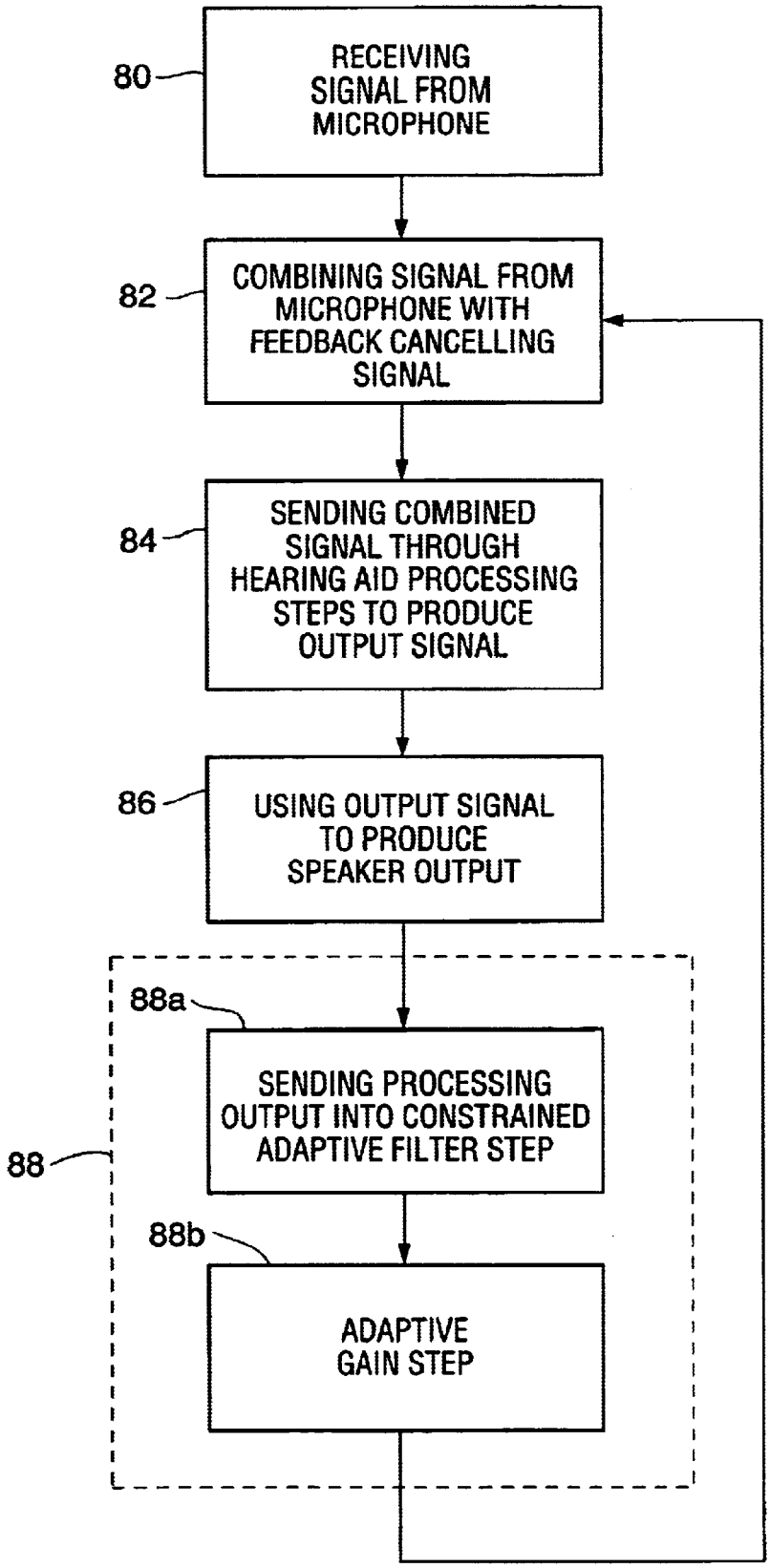
FIG. 4 is a flowchart illustrating the operation of the multiple-stage feedback-cancellation system of the present invention.

FIG. 4 is a diagram that illustrates a program running the two-stage adaptive feedback cancellation program. Data is received from the microphone in step 80. The data is combined with the feedback cancellation signal in step 82. This combination is preferably a subtraction of the feedback canceling signal from the signal from the microphone. In step 84, the combined signal is sent to the hearing-aid processing steps to produce a hearing-aid processing output. In step 86, the output signal is used to produce the speaker output. This is preferably done by providing the hearing-aid processing output to a D/A converter which is then sent to the speaker. Step 88 is a feedback cancellation step. Step 88 includes step 88*a* in which a processing output is sent to the constrained adaptive filter. In step 88*b*, an adaptive gain step is done.

The adaptive gain can be replaced by an L'th tap adaptive FIR filter. The value of L usually should be much less than K, say, L=1 or 2. The coefficients of this L'th adaptive FIR filter can be updated by minimizing $E[e^2(n)]$ with assuming that the coefficients of the (K−1)'th adaptive FIR filter are known as used in updating the adaptive gain.

The adaptive gain, gain(m), can be calculated in another manner. For example a more complex but smoother mode is described by the equation:

$$gain(m) = \frac{\alpha_1 Rvs(m) + \beta_1 Rvs(m-1)}{\alpha_2 Rvv(m) + \beta_2 Rvv(m-1)} \quad \text{Equation 9}$$

where Rvs(m−1) is the cross-correlation between $v_n(m-1)$ and $s_n(m-1)$ and Rvv(m−1) are the power of $v_n(m-1)$, respectively, and can be estimated as Equations 5 and 6 show, $\alpha_1$, $\alpha_2$, $\beta_1$, $\beta_2$, are the smooth parameters with the value from zero to the unity. Also, it should meet $\beta_1=1-\alpha_1$, and $\beta_2=1-\alpha_2$. In addition, $\alpha_1$ and $\alpha_2$ can take the same value.

Concerning the adaptive algorithms for updating the weights of the finely adaptive FIR filter, any LMS-based, LS-based, TLS-based adaptive algorithm can be used in this scheme. Also, instead of block-by-block updating, a sample-by-sample version can be used as follows:

$$w_k(m,n+1)=w_k(m,n)+2\mu^*\text{gain}(m)^*e_n(m)d_{n-k}(m)-2\mu\beta[w_k(m,n)-w_k(0)] \quad \text{Equation 10}$$

$$w_k(m,0)=w_k(m-1,N-1) \quad \text{Equation 11}$$

Moreover, adaptive lattice filter can be used in this scheme as well. All these will be determined according to the trade-off between the performance and cost (complexity, etc.) in practical applications.

Note that in a preferred embodiment the adaptive gain step uses a single gain value. The adaptive gain could have some filtering with the gain as long as the system can ensure that the constrained adaptive filter and the gain filter do not interact in such a manner as to produce artifacts if the input signal is a narrow band one.

It will be appreciated by those of ordinary skill in the art that the invention can be implemented in other specific forms without departing from the spirit or character thereof. The presently disclosed embodiments are therefore considered in all respects to be illustrative and not restrictive. The scope of the invention is illustrated by the appended claims rather than the foregoing description, and all changes that come within the meaning and range of equivalents thereof are intended to be embraced herein.

What is claimed is:

1. A system including:

a sound processing unit producing an output;

a multi-stage feedback canceling unit receiving the output of the sound processing unit, the multi-stage feedback canceling unit producing feedback canceling signal, the multi-stage feedback canceling unit including a constrained adaptive filter and an adaptive gain modifying unit for amplifying a signal output from the constrained adaptive filter; and a combining unit combining the feedback canceling signal with an input signal and providing the combined signal as the input to the sound processing unit.

2. The system of claim 1 wherein the adaptive gain unit produces a single gain value for all frequencies.

3. The system of claim 1 wherein the adaptive gain modifying unit modifies the gain differently at different frequencies.

4. The system of claim 1 wherein the sound processing comprises hearing-aid processing.

5. The system of claim 1 wherein the combining unit comprises a unit which subtracts the feedback canceling signal from the input signal.

6. The system of claim 1 wherein the sound processing unit, multi-stage feedback canceling unit, and combining unit are implemented as a processor running a software program.

7. The system of claim 1 wherein the adaptive gain is determined by the ratio of the correlation of the output of the constrained adaptive filter with the sample of microphone output over the autocorrelation of the constrained adaptive filter output.

8. The system of claim 1 wherein the constrained adaptive filter uses a number of initiation coefficients, the initiation coefficients being determined before operation of the system.

9. The system of claim 8 wherein the initiation coefficients are determined from a test sound environment.

10. A method comprising:

combining a feedback canceling signal with an input signal;

doing sound processing on the combined signal to produce an output; and producing the feedback canceling signal, the producing step using the output of the sound processing step, the producing step including the sub-steps of doing a constrained adaptive filtering and doing an adaptive amplifying gain modification.

11. The method of claim 10 wherein the adaptive gain modification uses a single gain value for all frequencies.

12. The method of claim 10 wherein the adaptive gain modification is different for different frequencies.

13. The method of claim 10 wherein the sound processing comprises hearing-aid processing.

14. The method of claim 10 wherein the constrained adaptive filtering is done by determining initiation coefficients, and wherein the constrained adaptive filtering is constrained by these initiation coefficients.

15. The method of claim 14 wherein the initiation coefficients are determined in a test environment.

16. The method of claim 10 wherein the adaptive gain is determined by the ratio of the correlation of the output of the constrained adaptive filter with the sampled microphone output over the autocorrelation of the output of the constrained adaptive filter.

17. The method of claim 10 wherein the combining step comprises subtracting the feedback canceling signal from the input signal.

* * * * *